US009944098B2

(12) United States Patent
Ide

(10) Patent No.: US 9,944,098 B2
(45) Date of Patent: Apr. 17, 2018

(54) PRINTING APPARATUS AND PRINTING METHOD

(71) Applicant: SEIKO EPSON CORPORATION, Tokyo (JP)

(72) Inventor: Kanako Ide, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/433,460

(22) Filed: Feb. 15, 2017

(65) Prior Publication Data

US 2017/0274681 A1 Sep. 28, 2017

(30) Foreign Application Priority Data

Mar. 22, 2016 (JP) ..... 2016-056872

(51) Int. Cl.
*B41J 13/00* (2006.01)
*B41J 2/01* (2006.01)
*B41J 2/21* (2006.01)

(52) U.S. Cl.
CPC ..... *B41J 13/0009* (2013.01); *B41J 2/01* (2013.01); *B41J 2/2103* (2013.01); *B41J 2/2132* (2013.01)

(58) Field of Classification Search
CPC ..... B41J 13/0018; B41J 13/009; B41J 3/62; B41J 13/00
See application file for complete search history.

(56) References Cited

U.S. PATENT DOCUMENTS 9,278,565 B2 * 3/2016 Imafuku ..... B41J 13/0009
2015/0375540 A1 * 12/2015 Ogawa ..... B41J 11/0095 347/16
2017/0066261 A1 * 3/2017 Nishida ..... B41J 3/60

FOREIGN PATENT DOCUMENTS

JP 2013-014090 A 1/2013

* cited by examiner

*Primary Examiner* — Julian Huffman

(57) ABSTRACT

A printing apparatus includes a data processing portion that creates image data that corresponds to printing of a predetermined unit, a transport portion that transports a printing medium, and a printing portion that executes the printing of the predetermined unit on the printing medium on the basis of the image data, in which the data processing portion determines whether or not the creation of image data precedes the printing, causes the printing portion to execute a first printing process for printing of a lower end portion of an image of a printing target in a case in which the creation of image data is precedent, and causes the printing portion to execute a second printing process for printing of the lower end portion in a case in which the creation of image data is not precedent.

12 Claims, 10 Drawing Sheets

FIG. 6A

| PASS NUMBER | IMAGE DATA AMOUNT A | IMAGE DATA AMOUNT B |
|---|---|---|
| 1 | 0 | 3 |
| 2 | 3 | 4 |
| 3 | 7 | 8 |
| 4 | 8 | 8 |
| 5 | 8 | 1 |

FIG. 6B

| PASS NUMBER | IMAGE DATA AMOUNT A | IMAGE DATA AMOUNT B |
|---|---|---|
| 1 | 0 | 3 |
| 2 | 3 | 4 |
| 3 | 7 | 8 |
| 4 | 12 | 8 |
| 5 | 16 | 1 |

PRINTING APPARATUS AND PRINTING METHOD

BACKGROUND

1. Technical Field

The present invention relates to a printing apparatus and a printing method.

2. Related Art

A printer that adopts overlapping transport, which performs transport in a state in which a portion of a succeeding printing medium (recording medium) overlaps with a portion of a preceding printing medium, in order to achieve an increase in the speed of printing is known (refer to JP-A-2013-14090.

In overlapping transport, a risk that the printing quality will be reduced as a result of a printing medium on an upper side approaching or coming into contact with a mechanism that performs printing, or the like, in a range in which the printing media overlap is assumed. Therefore, as long as overlapping transport is used, it is also necessary execute a process for avoiding such a risk in conjunction with the transport.

In addition, in order to genuinely realize an increase in the speed of printing due to overlapping transport, the temporal relationship between the creation of image data used in printing, and printing based on the image data is an important factor. Depending on the relationship, even if the transport of a succeeding printing medium is sped up as a result of overlapping transport, there are also cases in which the overlapping transport does not contribute to an increase in the speed of printing. It cannot be said that executing overlapping transport that does not contribute to an increase in the speed of printing is suitable considering the above-mentioned risk that is assumed.

SUMMARY

An advantage of some aspects of the invention is to provide a printing apparatus and a printing method that contribute to the securing of quality and an increase in speed of printing by switching a process depending on the relationship.

According to an aspect of the invention, there is provided a printing apparatus including a data processing portion that creates image data that corresponds to printing of a predetermined unit, a transport portion that transports a printing medium, and a printing portion that executes the printing of the predetermined unit on the printing medium on the basis of the image data, in which the data processing portion determines whether or not the creation of image data precedes the printing, causes the printing portion to execute a first printing process for printing of a lower end portion of an image of a printing target in a case in which the creation of image data is precedent, and causes the printing portion to execute a second printing process for printing of the lower end portion in a case in which the creation of image data is not precedent.

According to the configuration, the printing process of the lower end portion of the image (also referred to as a lower end process) is switched depending on whether or not the creation of image data precedes the printing, or in other words, whether or not overlapping transport should be executed. As a result of this, it is possible to contribute to the securing of quality and an increase in the speed of the printing by executing the lower end process (the first printing process) that evades the risk in a case in a case in which overlapping transport should be executed, for example.

According to the aspect of the invention, the printing portion may cause the transport portion to execute overlapping transport, which transports a portion of a succeeding printing medium overlapped with a blank space on the lower end portion side of the printing medium in a case in which the first printing process is executed.

According to the configuration, in a case in which the creation of the image data precedes the printing, it is possible to execute the first printing process and overlapping transport of the lower end portion. As a result of this, the overlapping transport is effective for an increase in the speed of printing, and the quality of printing is also secured.

According to the aspect of the invention, the first printing process may be a process that prints the lower end portion on the printing medium using only nozzles of a portion on an upstream side in the transport among a plurality of nozzles for discharging an ink that the printing portion includes.

According to the configuration, the posture of the printing medium, which is subjected to printing during printing of the lower end portion, is easy to stabilize, and the risk is avoided even in a case in which overlapping transport is executed in conjunction with the printing.

According to the aspect of the invention, the second printing process may be a process that prints the lower end portion on the printing medium preferentially using nozzles of a downstream side in the transport among a plurality of nozzles for discharging an ink that the printing portion includes. Alternatively, the second printing process may be a process that prints the lower end portion on the printing medium in a state in which nozzles that are furthest on an upstream side, among a plurality of nozzles for discharging an ink that the printing portion includes, are caused to correspond to a position on the printing medium at which a predetermined distance of blank space is left open toward a downstream side of the transport from an end on the upstream side of the transport of the printing medium.

According to the configuration, in a case in which the creation of the image data does not precede the printing, it is possible to suppress a reduction in the throughput of the printing apparatus by performing the second printing process, which, in a relative manner, contributes more to an increase in speed than the first printing process.

According to the aspect of the invention, the data processing portion may store image data created for each predetermined unit in a predetermined buffer, the printing portion may execute printing by reading the image data from the buffer, and the data processing portion may perform the determination on the basis of the amount of the image data of each predetermined unit, and a pre-printing image data amount that is stored in the buffer.

According to the configuration, it is possible to accurately determine whether or not the printing precedes the creation of the image data, and in addition, to what extent the printing precedes the creation of the image data.

The technical idea of the invention can also be realized by means other than an object such as a printing apparatus. For example, it is possible to define a method (a printing method) including each process that the printing apparatus executes as the invention. In addition, a program that causes a computer to execute such a method, and a computer-readable storage medium in which the program is stored can respectively form the invention.

BRIEF DESCRIPTION OF THE DRAWINGS

The invention will be described with reference to the accompanying drawings, wherein like numbers reference like elements.

FIGS. 6A and 6B are views that show a relationship between a pass number and each image data amount.

DESCRIPTION OF EXEMPLARY EMBODIMENTS

Hereinafter, embodiments of the invention will be described with reference to each drawing. Additionally, each drawing is merely an illustrative example for describing the embodiments.

1. Schematic Description of Apparatus

Figure 1:
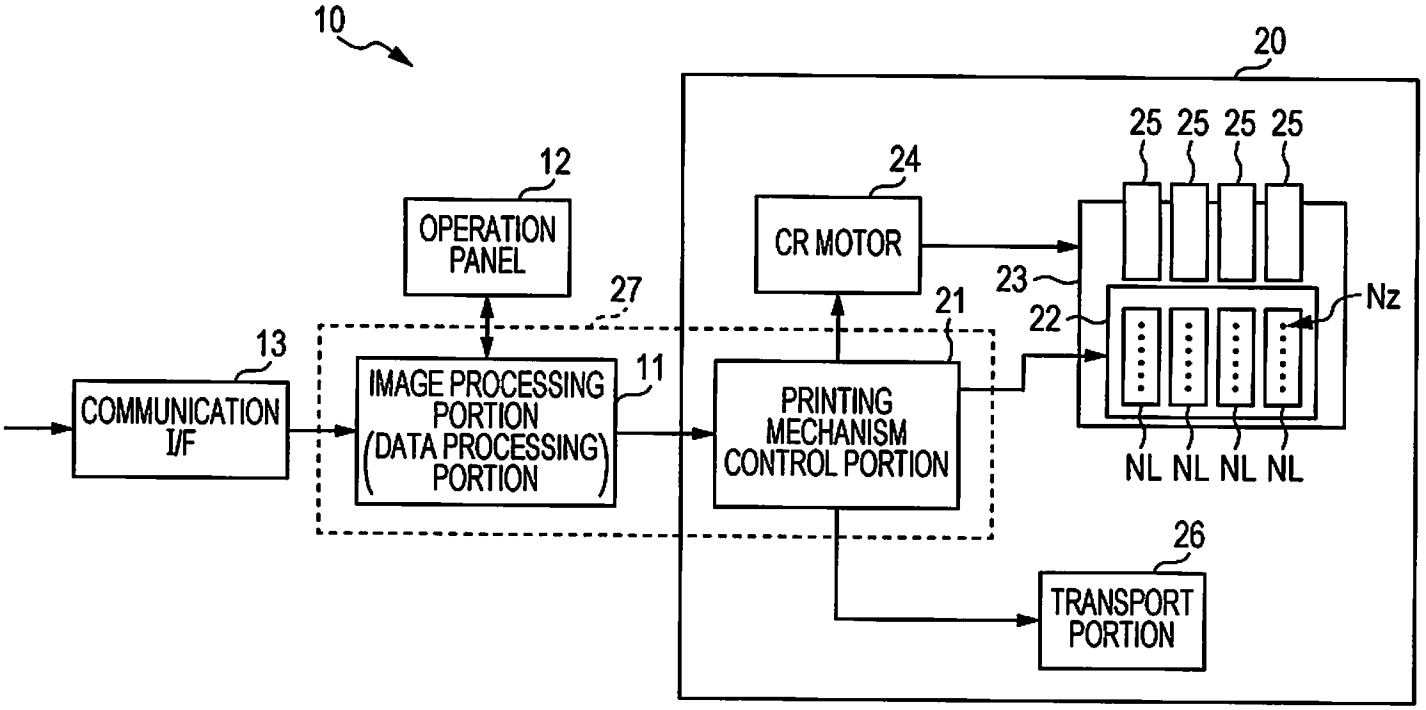
FIG. 1 is a block diagram that shows a schematic configuration of a printing apparatus.

FIG. 1 shows a configuration of a printing apparatus 10 according to the embodiment in a simplified manner in a block diagram. For example, the printing apparatus 10 can be understood as a product such as a printer, a multifunction machine that includes the functions of a printer, or the like. In addition, the printing apparatus 10 can be referred to as a printing control apparatus by referring to a portion of or all of the portions of such a product. The printing apparatus 10 is an example of an execution main constituent of a printing method according to the invention.

In FIG. 1, the printing apparatus 10 is illustrated by way of example as a configuration that includes an image processing portion 11, an operation panel 12, a communication interface (I/F) 13, and a printing portion 20. For example, the image processing portion 11 is configured to include an IC, which includes a CPU, a ROM, a RAM, and the like, another storage medium, and the like.

The image processing portion 11 executes various processes that are necessary in printing including the creation of image data by executing arithmetic processes in accordance with a program stored in the ROM, or the like, by using the RAM, or the like, as a work area. The image processing portion 11 may be interpreted as having some of the functions of a main controller that performs overall control of the printing apparatus 10.

The operation panel 12 includes various buttons for receiving operation of a user, a display portion for displaying various information relating the printing apparatus 10, and the like. The display portion, which the operation panel 12 includes, can function as a touch panel. The image processing portion 11 acquires input data from external equipment, which is not illustrated in the drawings, via the communication interface 13. The input data is a data file in which a printing target image (an image including objects such as photographs, CG, characters, and the like, that the user selects arbitrarily, hereinafter, a target image) is represented using a particular format. The communication interface 13 is a collective term for an interface for connecting the printing apparatus 10 to external equipment in either a wired or wireless manner.

Various equipment, such as a smartphone, a tablet type terminal, a digital still camera, a personal computer (PC), or a scanner, for example, which corresponds to an input source of the information required in printing of the printing apparatus 10 can correspond to external equipment. The printing apparatus 10 can be connected to external equipment via the communication interface 13 using various means and communication standards such as a USB cable, a wired network, wireless LAN, or electronic mail communication, for example. Naturally, the printing apparatus 10 may read input data from an internal storage medium, or an external storage medium such as a memory card inserted in a communication port, which is not illustrated in the drawings.

The image processing portion 11 executes data processing (a data processing step) for creating image data from the input data. Considering this, the image processing portion 11 may be referred to as data processing portion.

Figure 2:
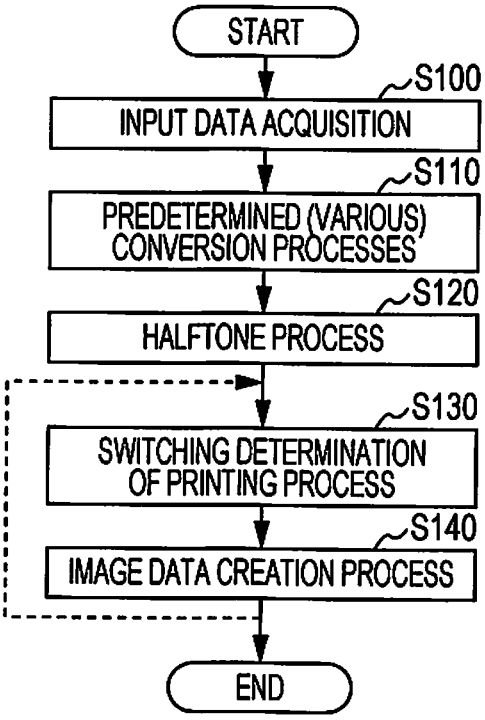
FIG. 2 is a flowchart that shows processes that an image processing portion executes.

FIG. 2 shows data processing that the image processing portion 11 executes to correspond to an amount that is equivalent to one page of input data using a flowchart. When input data is acquired via the communication interface 13 (Step S100), the image processing portion 11 carries out a predetermined conversion process on the input data (Step S110). The conversion process referred to in this instance includes various known conversion processes such as format conversion of data, resolution conversion, and color (color system) conversion. As a result of Step S110 being carried out, the input data is converted into bitmap data, in which the color of each pixel is represented using the output color system (for example, a color system using each ink color of cyan (C), magenta (M), yellow (Y), and black (K)) adopted by the printing apparatus 10.

In Step S120, the image processing portion 11 creates halftone data, in which a target image is represented using a dot pattern, by executing a halftone process on the data after Step S110.

A dot pattern is an arrangement of dot on (in other words, ink discharge) and off (in other words, ink non-discharge), and can also be referred to as a stipulating the formation and non-formation of a dot for each pixel. In a case in which the printing apparatus 10 is a model that uses CMYK ink in the above-mentioned manner, the halftone data includes data that stipulates dot on and off for each of CMYK and for each pixel. Furthermore, in addition to two-value data that merely shows dot on and off, the halftone data may be multi-value (four values) data that shows any one of a plurality of sizes of dot for which the volume per single droplet is mutually different (for example, a plurality of sizes of dot referred to as a large dot, a medium dot, a small dot, and the like) or dot off.

After then creation of the halftone data, the image processing portion 11 executes switching determination (Step S130) of the printing process. Furthermore, the image processing portion 11 executes an image data creation process (Step S140), which creates image data that corresponds to printing of a predetermined unit from the halftone data, depending on the determination result of Step S130. The details of Steps S130 and S140 will be described later.

The printing portion 20 performs printing on the printing medium on the basis of the image data, or in other words, is a mechanism that realizes a printing step. Hereinafter, the description will be continued with the printing medium set as sheets of paper, but a configuration in which a raw material other than paper is used as the printing medium may also be used. The printing system adopted by the printing portion 20 is an ink jet system, and the printing portion 20 includes a printing mechanism control portion 21, a printing head 22, a carriage 23, a carriage (CR) motor 24, ink cartridges 25, and the like. The printing mechanism control portion 21 is a circuit that is configured to include an IC, various storage media, and the like, and controls the behavior of the printing portion 20 in accordance with a program. In addition, the printing apparatus 10 includes a transport portion 26 that transports the printing medium, or in other words, realizes a transport step. The transport portion 26 may also be treated as a configuration that is included in a portion of the printing portion 20. The printing mechanism control portion 21 can be referred to as a at least a portion of a control portion 27 that controls the printing portion 20 and the transport portion 26. In addition, the control portion 27 may be understood by using the image processing portion 11 and the printing mechanism control portion 21 in conjunction with one another.

The printing head 22 includes a plurality of nozzles Nz, and discharges supplied liquid (ink) from each nozzle Nz. The printing head 22 may also be referred to as a character printing head, a recording head, a liquid discharging (ejecting) head, or the like. In FIG. 1, the nozzles Nz, which are represented by dots, and nozzle rows NL, in which the nozzles Nz are unidirectionally aligned, are illustrated by way of example. The printing head 22 is mounted in the carriage 23, and the carriage 23 moves along a predetermined main scanning direction as a result of being subjected to a motive power by the CR motor 24. The driving of the CR motor 24 is controlled by the printing mechanism control portion 21.

A plurality of ink cartridges 25, for example, an ink cartridge 25 of each ink of CMYK, is mounted in the carriage 23. Each ink cartridge 25 supplies ink to the printing head 22. The ink cartridges 25 may be installed in a predetermined position inside the printing apparatus 10 rather than being mounted in the carriage 23.

The transport portion 26 performs transport of sheets of paper according to the control of the printing mechanism control portion 21. The transport portion 26 includes a roller for transporting the sheets of paper in a predetermined transport direction, a motor for causing the roller to rotate, and the like. The transport direction is basically orthogonal to the main scanning direction. The transport portion 26 may have a configuration that includes an auto document feeder (ADF) that is capable of continuously transporting sheets of paper from a supply source of sheets of paper such as a supply tray, a supply cassette, or the like, which is not illustrated in the drawings. Furthermore, the transport portion 26 is capable of executing overlapping transport, which transports a portion of a succeeding sheet of paper overlapped with a blank space on the lower end portion side of an image that is printed on the sheet of paper. However, the transport portion 26 executes overlapping transport depending on the determination result of Step S130.

The printing mechanism control portion 21 transmits image data, which corresponds to printing of the predetermined unit created by Step S140 (FIG. 2), to the printing head 22. A driving signal (a type of pulse) may also be output to the printing head 22 in conjunction with an electrical signal that is equivalent to the image data from the printing mechanism control portion 21. Although detailed description will be omitted, in the printing head 22, ink discharge and non-discharge from each nozzles Nz is represented based on the image data by switching the application of the driving signal to a driving element provided for each nozzles Nz depending on dot on and off information (or alternatively, information of large dot on, medium dot on, small dot on or dot off) for each pixel that the image data represents. The printing head 22 realizes printing of a target image by forming dots of ink on a sheet of paper that the transport portion 26 transports by performing ink discharge from each of such nozzles Nz during movement in the main scanning direction due to the carriage 23.

The term "printing of the predetermined unit" mentioned above refers to a single scan (also referred to as a pass) of the printing head 22. A pass refers to a process in which the printing head 22 discharges ink on the basis of the image data in accordance with movement from one end side to the other end side in the main scanning direction due to the carriage 23, or movement to the one end side from the other end side. It is possible to complete a target image on a single sheet of paper in a plurality of passes as a result of the printing portion 20 repeating a cycle of acquiring image data, which corresponds to the printing of the predetermined unit (a single pass) from the image processing portion 11, causing the transport portion 26 to execute transport of the printing medium of a predetermined distance (a reference paper feeding amount), and executing a pass using the printing head 22 based on the acquired image data.

The processes of Steps S130 and S140 are repeated as shown by the dashed line arrow in the flowchart of FIG. 2. More specifically, the image processing portion 11 repeats the processes by returning to Step S130 each time image data that corresponds to printing of the predetermined unit (a single pass) is created in Step S140. The image processing portion 11 finishes the flowchart of FIG. 2 at a timing at which creation of image data that corresponds to a final pass among passes of a page is finished in Step S140.

2. Relationship Between Pass and Image Data

Figure 3:
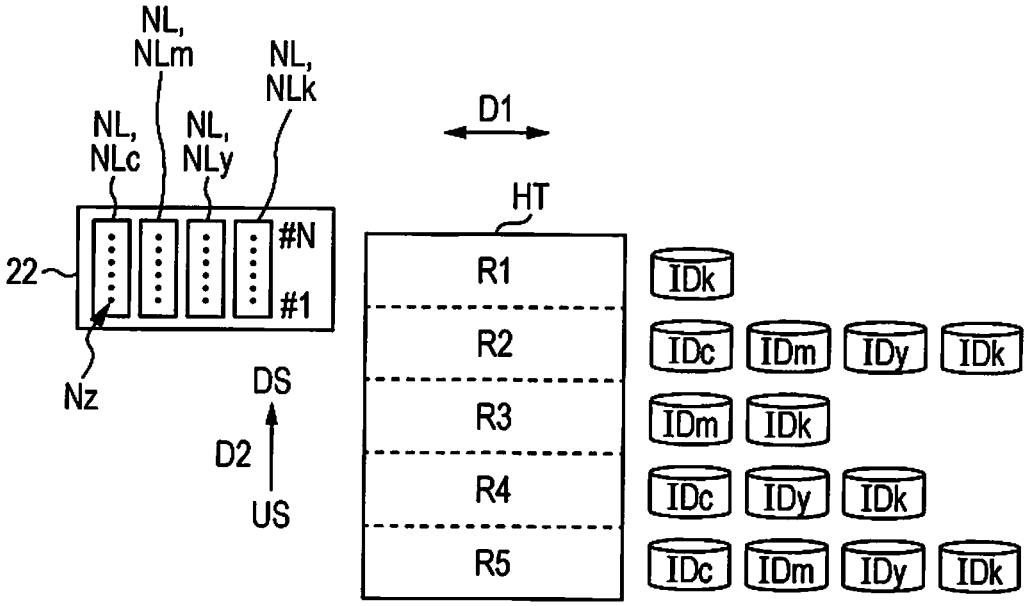
FIG. 3 is a view for describing image data of each pass.

FIG. 3 is a view for describing an example of image data for each pass, which the image processing portion 11 creates in Step S140. In FIG. 3, image data IDc, IDm, IDy, and IDk of each pass of a case in which halftone data HT of a single page is decomposed into pass units is illustrated by way of example. Band form divided regions R1, R2, R3, R4, and R5, which are represented by separating the halftone data HT using broken lines, are equivalent to regions that are respectively printed on in a single pass (a first pass, a second pass, a third pass, a fourth pass, and a fifth pass). The reference symbol D1 shows the main scanning direction, and the reference symbol D2 shows the transport direction. In the halftone data HT, the divided regions R1, R2, R3, R4, and R5 are respective regions that are aligned along an orientation that corresponds to the transport direction D2. The widths (the length in the transport direction D2) of the divided regions R1, R2, R3, R4, and R5 is determined in advance depending on the number of raster lines over which the printing head 22 prints in a single pass (for example, the number of nozzles Nz that configure a nozzle row NL). A raster line is a linear pixel group that is represented by pixels that are continuously aligned in a direction that corresponds to the main scanning direction D1. The divided regions R1, R2, R3, R4, and R5 are respectively bundles of raster lines. In addition, the widths of divided regions R1, R2, R3, R4, and R5 is equivalent to the above-mentioned reference paper feeding amount.

In FIG. 3, the nozzle rows NL (NLc, NLm, NLy, and NLk) of each ink color (CMYK) are illustrated by way of example to correspond to a single divided region (the divided region R1) for reference purposes. Each nozzle row NL that the printing head 22 includes is configured by a total N of the nozzles Nz of nozzle numbers #1 to #N, which are aligned at a predetermined pitch from an upstream side US in the transport direction D2 to a downstream side DS. The specific value of the N is not limited, and as one example, N=400. In FIG. 3 (and FIG. 1), the nozzle rows NL are represented in an extremely simple manner, but for example, a nozzle row NL that corresponds to a single ink color may be configured by a plurality of nozzle rows, the direction that the nozzle row NL is directed toward need not be parallel to the transport direction D2, the positions of individual nozzles Nz may be shifted in the main scanning direction D1, or the like.

In a case of referring to FIG. 3, the image processing portion 11 creates the image data IDk to correspond to the first pass in a case in which Step S140 of the flowchart of FIG. 2 is initially executed. The image data IDk, which corresponds to the first pass, is an aggregation of pixels for which dot on and off of K ink is stipulated in the divided region R1 of the halftone data HT, and is data in which the nozzle Nz to which the data corresponds (which of the nozzle numbers #1 to #N of the nozzle row NLk of K ink the data is allocated to) is determined for each pixel. In a similar manner, according to the example of FIG. 3, the image processing portion 11 creates the image data IDc, IDm, IDy, and IDk to correspond to the second pass (the divided region R2 that is printed on in the second pass) in the second repetition of Step S140. The image processing portion 11 creates the image data IDm and IDk to correspond to the third pass (the divided region R3 that is printed on in the third pass) in the third repetition of Step S140, creates the image data IDc, IDy and IDk to correspond to the fourth pass (the divided region R4 that is printed on in the fourth pass) in the fourth repetition of Step S140, and creates the image data IDc, IDm, IDy, and IDk to correspond to the fifth pass (the divided region R5 that is printed on in the fifth pass) in the final (fifth repetition of) Step S140. Naturally, whether or not the image data of each pass is present or absent for all ink colors (CMYK) is a result that is dependent on the color of ink that is originally used in a target image.

Figure 4:
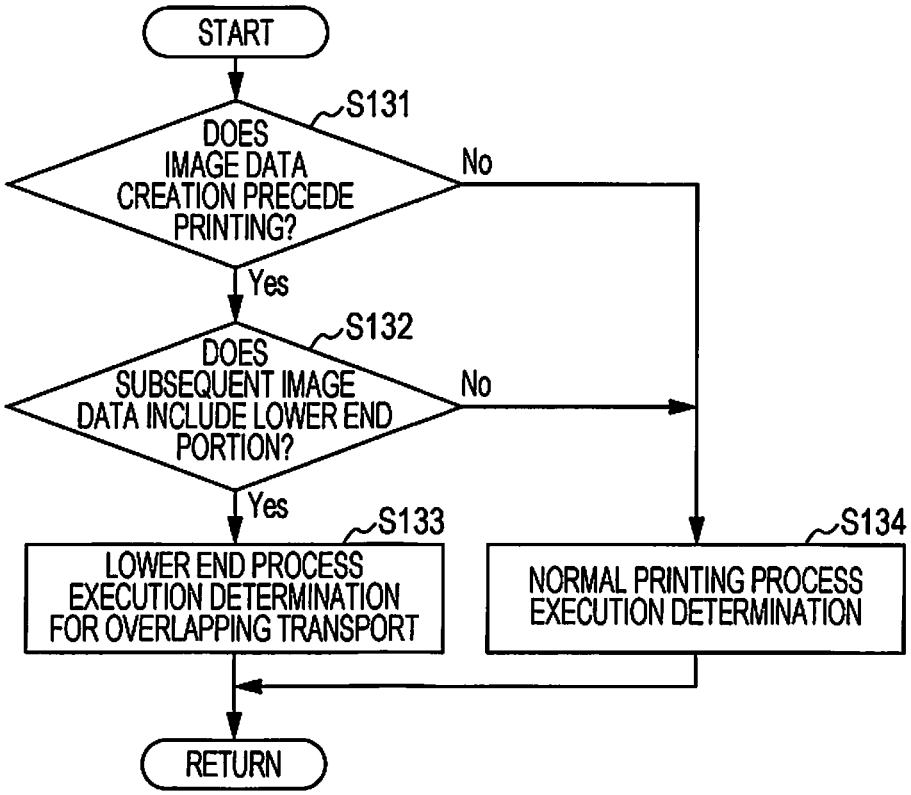
FIG. 4 is a flowchart that shows details of switching determination.

3. Description of Switching Determination and Processes Depending on Corresponding Determination FIG. 4 shows switching determination of the printing process in Step S130 using a flowchart. In Step S131, the image processing portion 11 determines whether or not the creation of image data currently precedes the printing (precedence determination). Further, the process proceeds to Step S132 in a case in which the creation of image data precedes the printing ("Yes" in Step S131), and the process proceeds to Step S134 in a case in which the creation of image data does not precede printing ("No" in Step S131).

Figure 5:
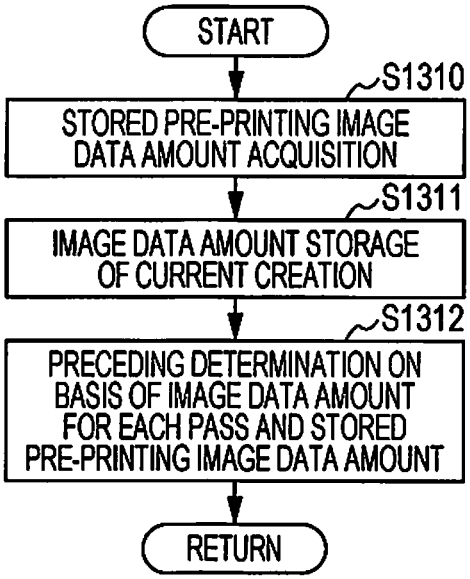
FIG. 5 is a flowchart that shows details of precedence determination.

FIG. 5 shows the details of the precedence determination in Step S131 using a flowchart. Firstly, in Step S1310, the image processing portion 11 acquires a stored pre-printing image data amount.

The handling of image data by the image processing portion 11 and the printing mechanism control portion 21 will be described as an example. The image processing portion 11 repeatedly executes a process of creating image data for each pass and storing the image data in a predetermined buffer (storage region) using input data (halftone data) of an amount corresponding to a single page as a basis (repeats Step S140). Meanwhile, the printing mechanism control portion 21 reads image data for each pass from the buffer, and causes printing to be executed based on the read image data (a single pass of the printing head 22). The image data is deleted from the buffer at the same time being read from the buffer. In such an instance, in Step S1310, the image processing portion 11 acquires a remainder from which the image data amount created on this occasion, or in other words, created in the immediately preceding Step S140 has been subtracted from the image data amount stored in the buffer at the current point in time, as the "stored pre-printing image data amount". Naturally, since Step S140 has not yet been performed at a timing at which Step S130 is initially executed in the flowchart of FIG. 2, the stored pre-printing image data amount is 0. In addition, the stored pre-printing image data amount is also 0 at a timing of Step S130 immediately after Step S140 is initially executed in the flowchart of FIG. 2.

In Step S1311, the image processing portion 11 stores the image data amount created on this occasion. The image data created on this occasion refers to image data created in the immediately preceding Step S140. Since Step S140 has not yet been performed at a timing at which Step S130 is initially executed in the flowchart of FIG. 2, the "image data amount created on this occasion" is 0. The image processing portion 11 stores the image data amount created for each Step S140, or in other words, the image data amount for each pass by performing the Step S1311 for each Step S130.

As described using FIG. 3, in a case in which the image processing portion 11 creates the image data of each pass as a result of division into the image data IDc, IDm, IDy, and IDk for each CMYK ink, the image processing portion 11 counts the number of the IDc, IDm, IDy, and IDk as the image data amount. Accordingly, for example, since the image data amount that is created to correspond to the first pass (the divided region R1) shown in FIG. 3 is image data IDk of an amount corresponding to a single color, the image data amount is 1. In addition, since the image data amount that is created to correspond to the second pass (the divided region R2) shown in FIG. 3 is image data IDc, IDm, IDy, and IDk of an amount corresponding to four colors, the image data amount is 4.

In Step S1312, the image processing portion 11 performs precedence determination on the basis of the image data amount for each pass stored for each Step S1311 and the stored pre-printing image data amount acquired in the most recent Step S1310.

FIG. 6A and FIG. 6B illustrate a relationship between pass number, an image data amount A and an image data amount B by way of example. The pass numbers 1 to 5 signify a total of five passes for printing a single page. The image data amount A indicates a "stored pre-printing image data amount" that the image processing portion 11 acquires in the Step S130 (Step S1310) immediately succeeding the image data for the pass of the pass number being created in Step S140. The image data amount B indicates an "image data amount created on this occasion (an image data amount for each pass)" that the image processing portion 11 stores in the Step S130 (Step S1311) immediately succeeding the image data for the pass of the pass number being created in Step S140. In the examples of FIGS. 6A and 6B, the maximum image data amount B is 8. The reason for this is that the number of items of image data of each ink color that can be created for each pass is 8, or in other words, the printing apparatus 10 uses eight colors of ink. In FIG. 3, and the like, an example in which the printing apparatus 10 uses a total of four colors of CMYK ink is illustrated by way of example, but naturally, the printing apparatus 10 may be a model that uses more types of ink such as light cyan (Lc), light magenta (Lm), grey (Lk) . . . , and the like, in addition to CMYK.

When the status in which the creation of image data precede printing is define briefly, it is a status in which the image data amount A is not 0. As long as the image data amount A is not 0, it can be said that there is a reserve of image data for a printing operation by the printing portion 20, and it is possible for the printing mechanism control portion 21 to read image data for a subsequent pass from the buffer without delay each time a pass of the printing head 22 is finished. Meanwhile, the image data amount A being 0 is a state in which there is not a reserve of image data for a printing operation of the printing portion 20. In this case, the image data created for a certain pass and stored in the buffer is used in printing as a result of being read immediately by the printing mechanism control portion 21. In a case in which there is not a reserve of image data, there are also cases in which it is necessary for the printing mechanism control portion 21 to temporarily stop movement of the carriage 23 and the printing head 22 and wait until image data for a subsequent pass is stored in the buffer.

Simply put, the image processing portion 11 determines that the creation of image data precedes the printing if the image data amount A is not 0, and determines that the creation of image data does not precede printing if the image data amount A is 0. However, in the present embodiment, the image processing portion 11 determines that the creation of image data precedes the printing in a case in which the creation of image data precedes the printing with a predetermined amount of leeway or more. As an example, in Step S131 (Step S1312), the image processing portion 11 determines that the creation of image data precedes the printing if it is before the initiation of or during the execution of a pass that is two passes prior to a certain pass when image data for the pass is created.

If pass number 4 illustrated by way of example in FIG. 6A is focused on, the image data amount A is 8, and the image data amount B that corresponds to pass number 3, which is a single pass prior, is also 8. Accordingly, in the example of FIG. 6A, image data B created to correspond to pass number 2, which is two passes prior, has already been used in printing (the second pass is finished) at a timing at which the image data (image data B) that corresponds to pass number 4 is created and finished in Step S140. In this case, since it cannot be said that it is before the initiation of or during the execution of a pass that is two passes prior to a pass when image data for the pass is created, the image processing portion 11 determines that the creation of image data does not precede printing in Step S131 in Step S130 after the image data that corresponds to the pass number 4 is created.

Meanwhile, if pass number 4 illustrated by way of example in FIG. 6B is focused on, the image data amount A is 12, the image data amount B that corresponds to pass number 3, which is a single pass prior, is 8, and the image data amount B that corresponds to pass number 2, which is two passes prior, is 4. Accordingly, in the example of FIG. 6B, image data B created to correspond to pass number 2, which is two passes prior, has not yet been used in printing (the second pass has not been initiated) at a timing at which the image data (image data B) that corresponds to pass number 4 is created and finished in Step S140. In this case, since it can be said that it is before the initiation of or during the execution of a pass that is two passes prior to a pass when image data for the pass is created, the image processing portion 11 determines that the creation of image data precedes the printing in Step S131 in Step S130 after the image data that corresponds to the pass number 4 is created.

In a case in which it is determined by the precedence determination that the creation of image data precedes the printing, the image processing portion 11 determines whether or not the image data to be created in the subsequent Step S140 will include a lower end portion of a target image (Step S132 in FIG. 4). Further, the process proceeds to Step S133 in a case in which it is determined that the image data to be subsequently created will include a lower end portion of a target image ("Yes" in Step S132), and, on the on the other hand, the process proceeds to Step S134 in a case in which it is determined that the image data to be subsequently created will not include the lower end portion of a target image ("No" in Step S132).

The lower end portion of a target image does not refer to the lower end portion of a page, but rather, refers to a lower end portion of a target image itself. The image data that includes the lower end portion of a target image corresponds to image data that corresponds to a final pass (a last pass) to print a single page. In FIG. 3, an example in which a single page is printed with a total of five passes is illustrated, but since, depending on the details of a target image, it is also possible for an image to be finished in a central portion or in the vicinity of an upper portion of a page, it is also possible for printing of the page to be finished in a fewer number of passes.

In Step S132, the image processing portion 11 determines "Yes" in a case in which the lower end portion of a target image is included in a divided region (for example, any one of the divided regions R1 to R5 such as those shown in FIG. 3) that is used as a creation source of image data in the subsequent Step S140, and on the other hand, determines "No" in a case in which the lower end portion of a target image is not included in a divided region that is used as a creation source of image data in the subsequent Step S140.

The image processing portion 11 may execute specification of the lower end portion of a target image, and specification of a divided region in which the lower end portion is included (for example, specification of which of the divided region R1 to R5) at the timing of the Step S132, but for example, executes the above-mentioned specification once in advance at a timing after executing the halftone process of Step S120 but before executing the switching determination of Step S130. Further, the determination of each repetition of the Step S132 may be performed using information that is specified in advance in this manner.

For example, the image processing portion 11 specifies the lower end portion of a target image on the basis of terminating end information that shows a terminating end of a file included in the input data (a data file) acquired in the Step S100. For example, the terminating end information is a code referred to as End Of File (EOF). The image processing portion 11 detects such terminating end information from the input data acquired in Step S100. The result depends on the format of the input data, but there are cases in which the terminating end information shows a position of the lower end of a target image within a page. Therefore, the image processing portion 11 can specify a divided region that includes a position within a page that the terminating end information shows as the divided region in which the lower end portion of a target image is included. In addition, within a divided region specified in this manner, a region that is further on the upstream side US of the position that the terminating end information shows (the position of the lower end of a target image) is specified as a blank space region, and regions other than the blank space region within the specified divided region are specified as the lower end portion of a target image.

However, depending on the format of the input data, there are also cases in which the above-mentioned terminating end information shows a lower end of a page itself rather than the lower end of a target image within the page. In consideration of such a status, the image processing portion 11 may specify the lower end portion of a target image by analyzing the input data in more detail. For example, among the halftone data HT, the image processing portion 11 sets a position that the terminating end information shows a position of a virtual lower end of a target image. Further, it is determined whether or not a raster line to which the position of the virtual lower end corresponds to is a blank space raster line in which a target image is not represented. A blank space raster line refers to a raster line that is configured by only pixels in which dot off is defined for all ink colors that the printing apparatus 10 uses. In a case in which a blank space raster line is determined, the image processing portion 11 determines whether or not an adjacent raster line that corresponds to the downstream side DS of the blank space raster line is a blank space raster line. The image processing portion 11 repeatedly executes such determination, and when it is determined that a certain raster line is not a blank space raster line (is a non-blank space raster line), authorizes the corresponding non-blank space raster line as the lower end of a target image. Further, the image processing portion 11 specifies the divided region in which the non-blank space raster line is included as the divided region in which lower end portion of a target image is included, and within the specified divided region, specifies the region on the downstream side DS from the non-blank space raster line as the lower end portion of a target image. Naturally, the image processing portion 11 may specify the lower end portion of a target image without being dependent on the terminating end information.

The image processing portion 11 determines the execution of a lower end process for overlapping transport in a case in which "Yes" is determined in both Steps S131 and S132 in this manner (Step S133). The term lower end process is a collective term for printing processes of the lower end portion of a target image, and the lower end process for overlapping transport will also be referred to as a first printing process. On the other hand, the image processing portion 11 determines the execution of a normal printing process in a case in which "No" is determined in either one of Steps S131 or S132 (Step S134). A normal lower end process, in which overlapping transport is not assumed, is also included in the normal printing process. The normal lower end process will also be referred to as a second printing process.

The image processing portion 11 executes the subsequent image data creation process (Step S140) depending on the result of the switching determination in Step S130, or in other words, the determination of which of the lower end process for overlapping transport or the normal printing process has been executed. In the lower end process for overlapping transport and the normal printing process, the relationships of the allocation of each pixel that configures the image data and each nozzle Nz differ. In the lower end process for overlapping transport, the printing head 22 prints the lower end portion of a target image on the printing medium using only nozzles Nz of a portion on the upstream side US. On the other hand, in the normal printing process, the printing head 22 prints a target image on the printing medium using nozzles Nz on the downstream side DS in a preferential manner.

In Step S140, the image processing portion 11 creates image data (first image data) that causes the printing portion 20 to execute the lower end process for overlapping transport in a case in which the execution of the lower end process for overlapping transport is determined in Step S130. More specifically, when the first image data is created to correspond to the last pass, which prints the lower end portion of a target image, the allocation destination of each pixel that configures a raster line that corresponds to the lower end of a target image is determined as the nozzle Nz (nozzle number #1) furthest on the upstream side US of a nozzle row NL. In addition, the relationship of the allocation of other pixels of the first image data and other nozzles Nz is also determined using such an allocation destination relationship as a basis. The printing portion 20 executes the last pass, or in other words, the lower end process for overlapping transport on the basis of such first image data.

In Step S140, the image processing portion 11 creates image data (second image data) that causes the printing portion 20 to execute the normal printing process in a case in which the execution of the normal printing process is determined in Step S130. More specifically, when the second image data is created to correspond to a single pass, the allocation destination of each pixel that configures a raster line that is positioned furthest on the downstream side DS within a divided region is determined as the nozzle Nz (nozzle number #N) furthest on the downstream side DS of a nozzle row NL. In addition, the relationship of the allocation of other pixels of the second image data and other nozzles Nz is also determined using such an allocation destination relationship as a basis. The printing portion 20 executes a single pass, or in other words, the normal printing process on the basis of such second image data.

Figure 7A:
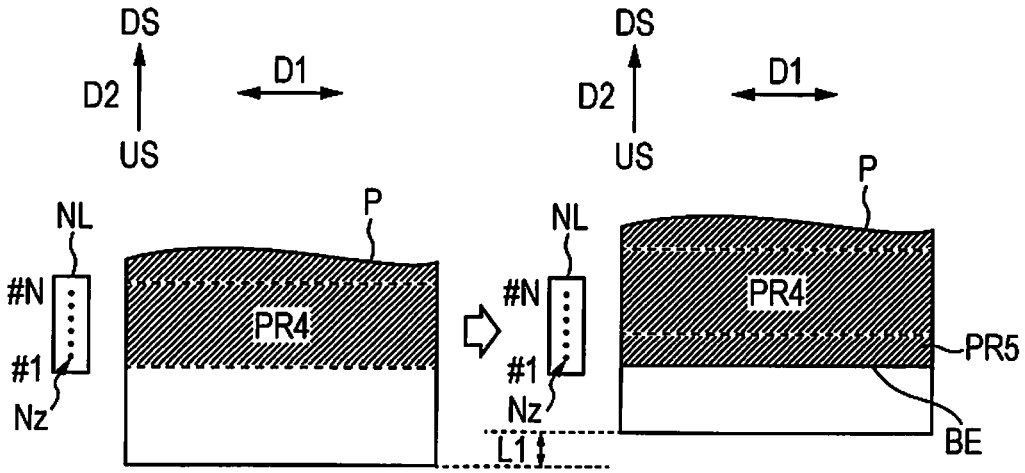
FIG. 7A is a view that shows an aspect in which a lower end process for overlapping transport is executed.
Figure 7B:
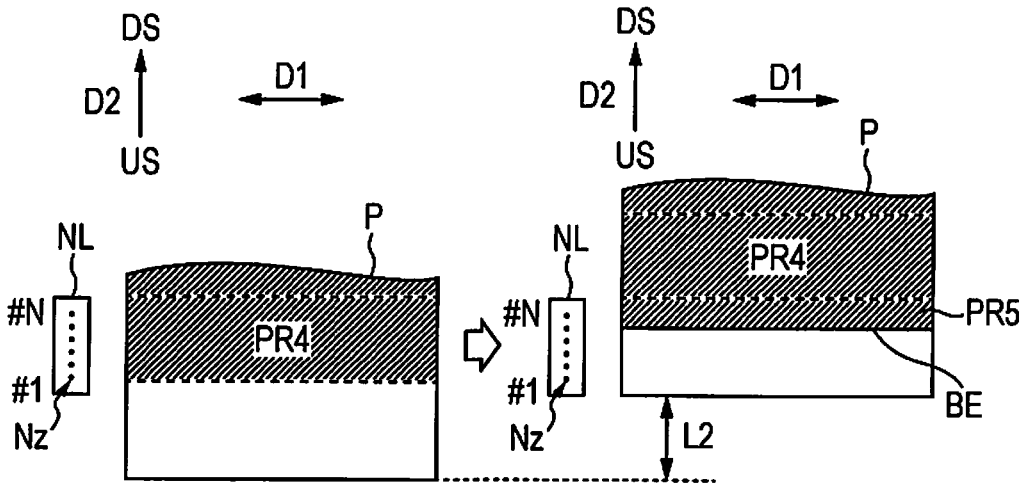
FIG. 7B is a view that shows an aspect in which a normal lower end process is executed.

FIG. 7A illustrates an aspect in which the printing portion 20 executes the lower end process for overlapping transport in the last pass for printing a single page by way of example, and FIG. 7B illustrates an aspect in which the printing portion 20 executes the normal printing process (the normal lower end process) in the last pass by way of example. In FIG. 7A, the relationship between a nozzle row NL and a sheet of paper P, as a printing medium, is shown, an aspect in which an image PR4 is printed on the sheet of paper P in a single pass prior to the last pass is shown on the left side, and an aspect in which an image PR5 is printed on the sheet of paper P in the last pass is shown on the right side. In a similar manner, in FIG. 7B, the relationship between the nozzle row NL and the sheet of paper P is shown, an aspect in which the image PR4 is printed on the sheet of paper P in a single pass prior to the last pass is shown on the left side, and an aspect in which the image PR5 is printed on the sheet of paper P in the last pass is shown on the right side. In FIGS. 7A and 7B, among the plurality of nozzle rows NL that the printing head 22 includes, only a single nozzle row NL is shown in a simplified manner.

In FIGS. 7A and 7B, the last pass is set as the fifth pass. In addition, the image PR4 is an image that is printed in the fourth pass as a result of image data that corresponds to the divided region R4 (refer to FIG. 3), and the image PR5 is an image that is printed in the last pass as a result of image data that corresponds to the divided region R5 (refer to FIG. 3), or in other words, is the lower end portion of a target image. A lower end BE of the image PR5 is the lower end of the target image.

In both FIGS. 7A and 7B, the fourth pass, in which the image PR4 is printed, is the normal printing process. When FIGS. 7A and 7B are compared, the nozzles Nz that are used in the printing of the image PR5, and the distance of paper feeding that the transport portion 26 executes during an interval before the last pass is initiated after the fourth pass is finished are different. In other words, the printing portion 20 prints the image PR5 using only a limited number of nozzles Nz on the upstream side US in a case in which the lower end process for overlapping transport is executed as the last pass (FIG. 7A). In addition, in such a lower end process for overlapping transport, the printing mechanism control portion 21 causes the transport portion 26 to transport (perform paper feeding) the sheet of paper P to the downstream side DS in the transport direction D2 up to a position at which the lower end BE of the target image is printed on by the nozzle Nz (nozzle number #1) furthest on the upstream side US after the finish of the fourth pass and before initiation of the last pass. In FIG. 7A, a paper feeding amount required in the lower end process for overlapping transport is shown using the reference symbol L1.

On the other hand, the printing portion 20 prints the image PR5 as normal using nozzles Nz on the downstream side DS in a preferential manner in a case in which the normal printing process (the normal lower end process) is executed as the last pass (FIG. 7B). In such a normal printing process (normal lower end process), the printing mechanism control portion 21 causes the transport portion 26 to transport (perform paper feeding) the sheet of paper P to the downstream side DS in the transport direction D2 up to a position at which the upper end of the image PR5 (the raster line furthest on the downstream side DS) is printed on by the nozzle Nz (nozzle number #N) furthest on the downstream side DS after the finish of the fourth pass and before initiation of the last pass. In FIG. 7B, a paper feeding amount required in the normal printing process (the normal lower end process) is shown using the reference symbol L2. The paper feeding amount L2 is the above-mentioned reference paper feeding amount. As can be understood from FIGS. 7A and 7B, paper feeding amount L1≤paper feeding amount L2.

The printing portion 20 executes overlapping transport in conjunction with printing in a case in which the lower end process for overlapping transport is executed as the last pass, and does not execute the overlapping transport in a case in which the normal printing process is executed.

Figure 8A:
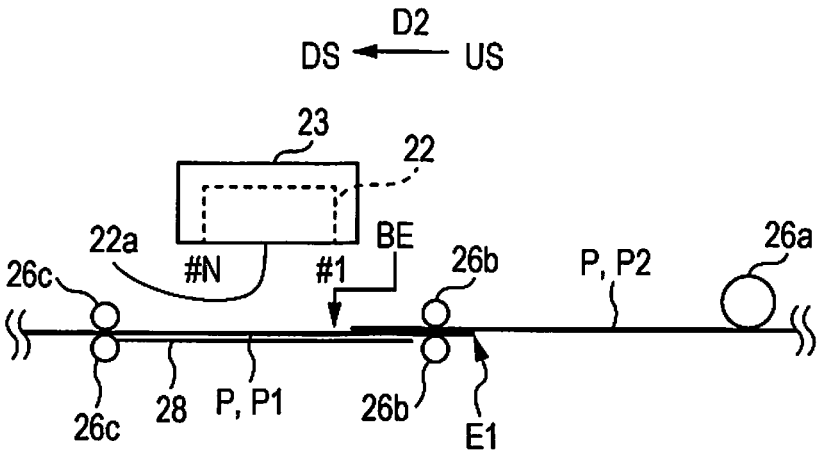
FIG. 8A is a view that shows an aspect in which the lower end process for overlapping transport and overlapping transport are executed.
Figure 8B:
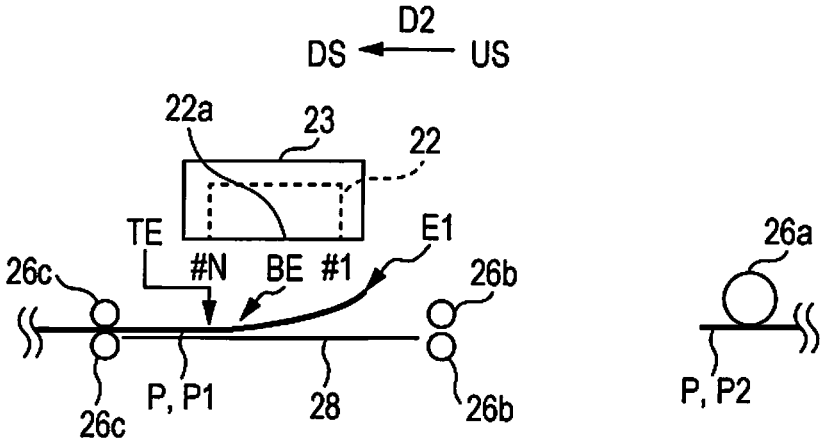
FIG. 8B is a view that shows an aspect in which a normal lower end process is executed.

FIG. 8A illustrates an aspect in which the lower end process for overlapping transport is executed as the last pass and overlapping transport is executed by way of example using a point of view that is directed toward the main scanning direction D1, and FIG. 8B illustrates an aspect in which the normal lower end process is executed as the last pass and overlapping transport is not executed by way of example using a point of view that is directed toward the main scanning direction D1 in a similar manner.

In FIGS. 8A and 8B, a nozzle opening surface of the printing head 22 is shown using the reference symbol 22*a*, and a platen that the printing apparatus 10 includes is shown as a portion of a transport pathway of sheets of paper P using the reference symbol 28. The nozzle opening surface 22*a* is a surface in which each nozzle Nz, which the printing head 22 includes, is opened. The platen 28 is a surface that faces the nozzle opening surface 22*a*, and the sheets of paper P are transported on the platen 28 by the transport portion 26. Naturally, the printing apparatus 10 also includes members (not illustrated in the drawings) other than the platen 28 for guiding the sheets of paper P along the transport pathway as appropriate. As an example of means for transporting the sheets of paper P, the transport portion 26 includes a paper supply roller 26*a*, a pair of transport rollers 26*b* and 26*b*, a pair of ejection rollers 26*c* and 26*c*, and the like. The pair of transport rollers 26*b* and 26*b* feed the sheets of paper P to the to the downstream side DS while holding the sheets of paper P therebetween, and in a similar manner, the pair of ejection rollers 26*c* and 26*c* feed the sheets of paper P to the downstream side DS while holding the sheets of paper P therebetween. One of the pairs of rollers may be a driven roller.

Among each of the illustrated rollers, the paper supply roller 26*a* is positioned furthest on the upstream side US, and rotates in order to supply the sheets of paper P to the downstream side DS from the supply source, which is not illustrated in the drawings. The pair of transport rollers 26*b* and 26*b* are installed in a position that is further on the downstream side DS than the paper supply roller 26*a* and is slightly further on the upstream side US than the carriage 23. The pair of ejection rollers 26*c* and 26*c* are installed in a position that is slightly further on the downstream side DS than the carriage 23. The pair of transport rollers 26*b* and 26*b* and the pair of ejection rollers 26*c* and 26*c* rotate in synchronization with one another in order to mainly perform paper feeding of the sheets of paper P and ejection thereof after printing. For example, the transport portion 26 includes a motor that causes the paper supply roller 26*a* to rotate, and a motor that causes the pair of transport rollers 26*b* and 26*b* and the pair of ejection rollers 26*c* and 26*c* to rotate, and the rotation of the paper supply roller 26*a* and the rotation of the pair of transport rollers 26*b* and 26*b* and the pair of ejection rollers 26*c* and 26*c* are controlled independently as a result of driving each of the above-mentioned motors.

Regarding FIGS. 8A and 8B, a sheet of paper P on which printing is currently being carried out is written as a preceding sheet of paper P1, and a succeeding sheet of paper P on which printing will be carried out subsequently is written as a succeeding sheet of paper P2. Incidentally, the sheets of paper P that are shown in FIGS. 7A and 7B correspond to preceding sheets of paper P1, and in FIGS. 7A and 7B, illustration of the succeeding sheets of paper P2 is omitted. According to the example of FIG. 8A, the lower end portion, or in other words, the image PR5, is printed as a result of the preceding sheet of paper P1 being subjected to ink discharge due to the last pass in a state in which paper feeding is carried out to a position at which the lower end BE of a target image is printed on by the nozzle Nz (nozzle number #1) furthest on the upstream side US (refer to FIG. 7A). In the above-mentioned manner, the paper feeding amount L1 required in the lower end process for overlapping transport is shorter than the reference paper feeding amount L2. Therefore, in the lower end process for overlapping transport, in a large number of cases, the preceding sheet of paper P1 is subjected to ink discharge in a state in which the vicinity of a trailing end E1 of the sheet of paper is held between the pair of transport rollers 26*b* and 26*b*.

The trailing end of a sheet of paper refers to an end of the sheet of paper that is directed toward the upstream side US, and a leading end of a sheet of paper refers to an end of the sheet of paper that is directed toward the downstream side DS. Since the vicinity of the trailing end E1 is pressed by the pair of transport rollers 26*b* and 26*b*, the preceding sheet of paper P1 seldom curls (curves) even if subjected to ink discharge due to the last pass.

In FIG. 8A, a state in which a portion of the leading end side of the succeeding sheet of paper P2 overlaps with the blank space (a range of the preceding sheet of paper P1 that is further on the upstream side US than the lower end BE of the target image) on the lower end portion side of the preceding sheet of paper P1 is shown. In other words, overlapping transport of the preceding sheet of paper P1 and the succeeding sheet of paper P2 is carried out. In a case in which the execution of the lower end process for overlapping transport is determined in Step S133 (FIG. 4), the image processing portion 11 instructs the printing mechanism control portion 21 to initiate the transport of the succeeding sheet of paper P2 by the transport portion 26 (the paper supply roller 26*a*) at a predetermined timing. At a point in time at which the determination is performed in Step S133, a pass that is a few passes prior to the last pass is being performed on the preceding sheet of paper P1 by the printing head 22, but as a result of performing instruction to initiate the transport of the succeeding sheet of paper P2 at the predetermined timing, for example, as shown in FIG. 8A, the succeeding sheet of paper P2 reaches a position that overlaps with the blank space on the lower end portion side of the preceding sheet of paper P1 at a point in time at which the last pass is initiated on the preceding sheet of paper P1.

On the other hand, according to the example of FIG. 8B, the lower end portion (the image PR5) is printed as a result of the preceding sheet of paper P1 being subjected to ink discharge due to the last pass in a state in which paper feeding is carried out to a position at which the upper end of the image PR5 (a raster line furthest on the downstream side DS) is printed on by the nozzle Nz (nozzle number #N) furthest on the downstream side DS (refer to FIG. 7B). The reference symbol TE in FIG. 8B shows the position of the upper end of the image PR5. In the normal printing process, paper feeding of the reference paper feeding amount L2 is executed, and in many cases the trailing end E1 of the preceding sheet of paper P1 is positioned further on the downstream side DS than the pair of transport rollers 26*b* and 26*b* at a point in time at which the last pass, or in other words, normal lower end process, is executed. The preceding sheet of paper P1, which is subjected to ink discharge due to the last pass in a state in which the vicinity of the trailing end E1 is not held between the pair of transport rollers 26*b* and 26*b* swells due to the moisture of the received ink, and as shown in FIG. 8B, it is likely that the trailing end E1 will curl. Additionally, in FIG. 8B, the shape with which the preceding sheet of paper P1 is curled is represented in an exaggerated manner that is easy to understand.

When the leading end side of the succeeding sheet of paper P2 overlaps with the preceding sheet of paper P1 in which the vicinity of the trailing end E1 is curled, the leading end of the succeeding sheet of paper P2 is raised upward by the trailing end E1 of the preceding sheet of paper P1, and there is a risk that the printing quality will be reduced as a result of the succeeding sheet of paper P2 coming too close to the printing head 22, coming into contact with the printing head 22, or the like. Therefore, in the present embodiment, the occurrence of the risk is evaded as a result of always executing the lower end process for overlapping transport in a case in which overlapping transport is performed. Since the timing of the initiation of transport of the succeeding sheet of paper P2 during the execution of the normal lower end process of the preceding sheet of paper P1, or in other words, the transport of the succeeding sheet of paper P2 in a case in which overlapping transport is not performed is publicly known, further reference thereto will be omitted.

4. Effects of Present Embodiment

In this manner, according to the present embodiment, the image processing portion 11 (the data processing portion) performs precedence determination of whether or not the creation of image data precedes the printing, causes the printing portion 20 to execute the first printing process (the lower end process for overlapping transport) for printing of the lower end portion of a target image in a case in which the creation of image data is precedent, and causes the printing portion 20 to execute the second printing process (the normal lower end process) for printing of the lower end portion in a case in which the creation of image data is not precedent. That is, it is possible to switch the lower end process depending on the temporal relationship between the creation of image data to be used in printing, and printing based on the image data.

As long as the creation of image data precedes the printing, it can be said that there in an increase in speed in printing using the execution of overlapping transport. On the other hand, as long as the creation of image data does not precede printing, there are cases in which a status such as the printing head 22 temporarily putting a subsequent pass on standby occurs, and therefore, there are cases in which there is not an increase in the speed of printing even if the transport of a succeeding sheet of paper is sped up using overlapping transport. In addition, as long as the creation of image data does not precede printing with a certain amount of leeway, there are also cases in which a succeeding sheet of paper does not overlap with a preceding sheet of paper at a suitable position or timing even if the transport of the succeeding sheet of paper is initiated using overlapping transport. In other words, in the present embodiment, whether or not there is a status in which overlapping transport should be executed is determined in a practical manner by performing the precedence determination. Further, in a case in which the creation of image data is precedent, the risk of overlapping transport is avoided, and an increase in the speed of printing is realized by executing the lower end process for overlapping transport and overlapping transport. In addition, as long as the creation of image data is not precedent, the normal lower end process is executed, and the occurrence of an unnecessary risk is avoided by not performing overlapping transport.

If the normal lower end process and the lower end process for overlapping transport are compared in a simplified manner isolated from overlapping transport, it can be said that the normal lower end process contributes to an increase in the speed of printing. The reason for this is that, simply put, the paper feeding amount of a single repetition is longer in a case of the normal lower end process. In addition, in the lower end process for overlapping transport, the nozzles Nz to be used in the last pass are limited to the nozzles Nz of a portion on the upstream side US (a predetermined number of nozzles Nz including the nozzle Nz of nozzle number #1). Therefore, depending on the size of an image (the lower end portion of a target image) to be printed in the last pass, there are also cases in which printing of the image to be printed in the last pass is not finished in a single pass using the nozzles Nz of the portion. In such a case, the image to be printed in the last pass is printed with a plurality of passes using the nozzles Nz of the portion (with paper feeding of a minute distance interposed therebetween), and therefore, more time is required. In the light of such a status, since the present embodiment does not execute overlapping transport and adopts the normal lower end process as the lower end process in a case in which the creation of image data is not precedent, it can be said that it is possible to accurately control decreases in the throughput of the printing apparatus 10.

The invention is not limited to the above-mentioned embodiment, the implementation of various aspects is possible within a range that does not depart from the scope of the invention, and it is also possible to adopt the embodiments, modification examples, and the like, that will be mentioned later. The embodiment that has been described up until this point will be referred to as a first embodiment for the sake of convenience.

5. Second Embodiment

Next, a second embodiment will be described. The second embodiment will be described focusing mainly on portions that differ from those of the first embodiment. In the second embodiment, the control portion 27 restricts the execution of overlapping transport by the transport portion 26 depending on the concentration of the lower end portion of a target image (the lower end portion concentration).

Figure 9:
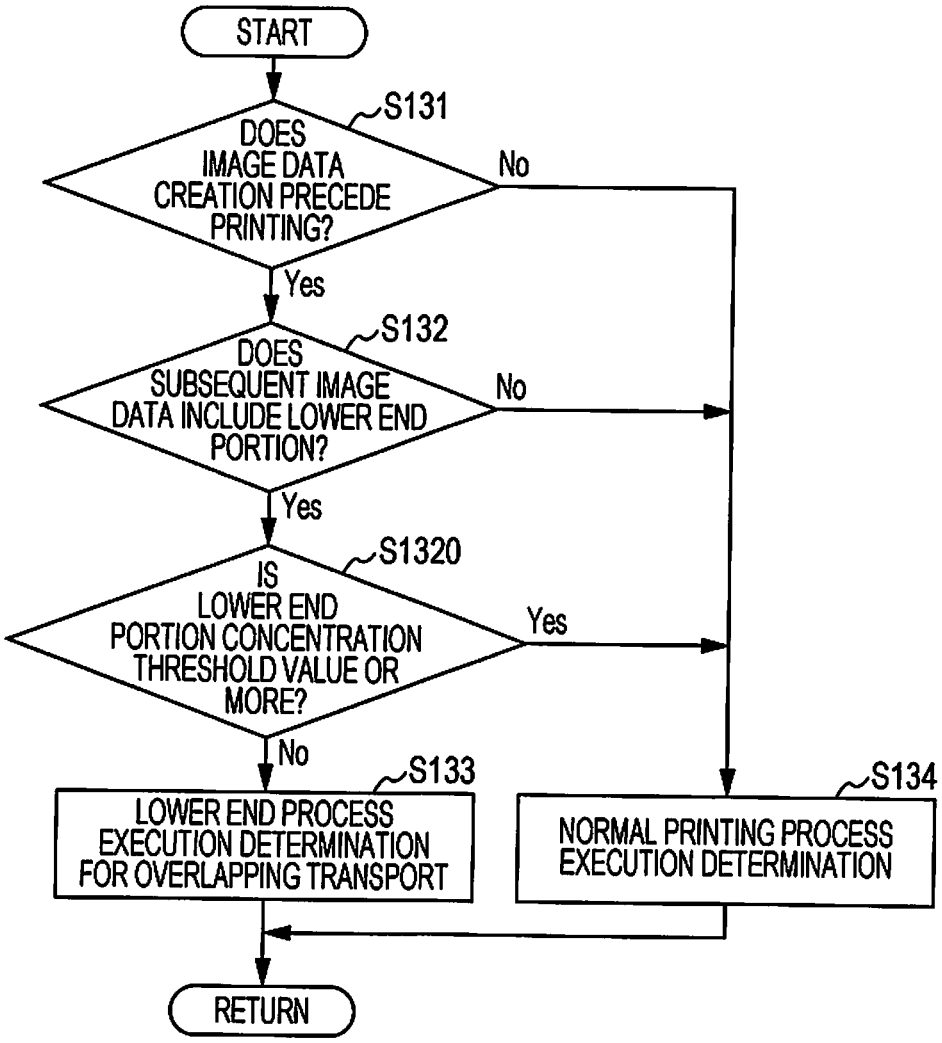
FIG. 9 is a flowchart that shows details of switching determination in the second embodiment.

FIG. 9 shows an example that differs from that of FIG. 4, which is switching determination of the printing process in Step S130 (FIG. 2) using a flowchart. When compared with FIG. 4, the determination of Step S1320 has been added to FIG. 9.

In a case in which "Yes" is determined in Step S132, the image processing portion 11 proceeds to Step S1320. In Step S1320, the image processing portion 11 determines whether or not the lower end portion concentration is a predetermined threshold value or more for the lower end portion of a target image specified in the above-mentioned manner. Further, the process proceeds to Step S134 in a case in which it is determined that the lower end portion concentration is high, that is, is the predetermined threshold value or more, and execution of the normal printing process is determined. On the other hand, the process proceeds to Step S133 in a case in which it is determined that the lower end portion concentration is low, that is, is less than the predetermined threshold value, and execution of the lower end process for overlapping transport is determined.

The image processing portion 11 counts the number of dot ons in a region that corresponds to the lower end portion of a target image on the basis of the halftone data HT, and it is possible to determine the lower end portion concentration on the basis of the count result. For example, the image processing portion 11 sets the sum total of the dots (dot ons) that each pixel, which configures the lower end portion of a target image, stipulates as a lower end portion dot sum total X. In this case, the dots of each ink color are respectively counted as a single dot. In addition, a value (total number of pixels of lower end portion Y×Z) obtained by multiplying a number of ink colors Z that the printing apparatus 10 uses (Z=4 in a case of a model that uses the four colors of CMYK ink) is multiplied by a number of pixels Y that configure the lower end portion of a target image is obtained. Further, it is determined that the lower end portion concentration is the predetermined threshold value or more if X/(Y×Z) is a predetermined threshold value or more, and it is determined that the lower end portion concentration is less than the predetermined threshold value if X/(Y×Z) is less than the predetermined threshold value.

In the above-mentioned manner, in a case in which dot on in the halftone data HT is divided into dots of different sizes such as a large dot on, a medium dot on, and a small dot on, the image processing portion 11 may be counted by applying a weighting that differs for each size of dot when counting the dot sum total X. For example, in a case in which a single large dot is counted as 1 dot, counting is performed so that a single medium dot is counted as 0.5 dots, a single small dot is counted as 0.2 dots, and the like. Alternatively, the image processing portion 11 may perform determination of whether the lower end portion concentration is high or low in a simplified manner by focusing on the number of dots of a specific ink (for example, K ink) only in the lower end portion of a target image. Alternatively, the image processing portion 11 may perform determination of whether the lower end portion concentration is high or low in a simplified manner on the basis of a ratio at which the number of pixels, which include a dot of 1 color or more, occupy a number of pixels Y that configures the lower end portion of a target image.

Alternatively, the image processing portion 11 may treat the ratio of dot on pixels within the divided region that includes the lower end portion of a target image (for example, the divided region R5) as the lower end portion concentration, and branch the process as a result of whether the lower end portion concentration is high or low.

After the process proceeds to Step S133 depending on the determination of Step S1320, in the same manner as that of the first embodiment, the printing portion 20 executes the lower end process for overlapping transport and overlapping transport when executing the last pass. In addition, after the process proceeds to Step S134 depending on the determination of Step S1320, in the same manner as that of the first embodiment, the printing portion 20 executes the normal lower end process (and overlapping transport is not executed) when executing the last pass. In other words, the control portion 27 differentiates the printing process (the lower end process) that the printing portion 20 executes for printing of the lower end portion of a target image depending on the lower end portion concentration.

In this manner, according to the second embodiment, the control portion 27 restricts the execution of overlapping transport depending on the lower end portion concentration of a target image. As a result of this, it is possible to restrict the execution of overlapping transport depending on the degree of curling of a sheet of paper P, which is altered depending on the lower end portion concentration, or in other words, depending on the probability of occurrence of the above-mentioned risk during the execution of overlapping transport. More specifically, in a case in which the lower end portion concentration is high, a large amount of ink is discharged onto a sheet of paper P due to the last pass, and therefore, it is possible to predict that the curling in the vicinity of the blank space on the lower end portion side will be great. Therefore, in a case in which the lower end portion concentration is a predetermined threshold value or more, the control portion 27 performs control so that the transport portion 26 does not execute overlapping transport.

Additionally, as a result of the lower end process for overlapping transport, the probability that, as shown in FIG. 8A, the last pass will be carried out in a state in which the vicinity of the of the trailing end E1 of a sheet of paper P is held between the pair of transport rollers 26*b* and 26*b* is increased.

However, due to the designed position of the pair of transport rollers 26*b* and 26*b*, the position of the lower end BE of a target image, or the like, even if the lower end process for overlapping transport is essentially performed it is not necessarily always possible to execute the last pass in a manner in which the vicinity of the of the trailing end E1 is held between the pair of transport rollers 26*b* and 26*b*. When such a status is taken into consideration, it can be said that the second embodiment, which prohibits overlapping transport in a case in which the lower end portion concentration of a target image is high even in a case in which "Yes" is determined in either one of the Steps S131 or S132 (FIG. 9), is a technique that reliably avoids the above-mentioned potential risk, which is caused by curling of a sheet of paper P during overlapping transport.

6. Modification Example

Specific examples of the normal lower end process in which overlapping transport is not assumed are not limited to the above-mentioned example. For example, the normal lower end process (the second printing process) may be a process that prints the lower end portion of a target image on a sheet of paper P in a state in which the nozzles Nz furthest on the upstream side US (nozzle number #1) is caused to correspond to a position on the sheet of paper P at which a distance of an amount corresponding to a predetermined blank space W is left open toward the downstream side DS from the trailing end of the sheet of paper P.

The width of the blank space W is determined in advance, and for example, is 3 millimeters. In other words, the position on the sheet of paper P at which a distance of an amount corresponding to the blank space W is left open toward the downstream side DS from the trailing end of the sheet of paper P is a position that is brought onto the inner side by 3 millimeters, for example, from the trailing end of the sheet of paper P. The position will be referred to as the fixed lower end BE' of a target image. That is, the modification example presents a lower end process that treats the fixed lower end BE', which is a position that is determined in advance, as the lower end of a target image, and performs printing by matching the position of the nozzles Nz furthest on the upstream side US (nozzle number #1) to that of the fixed lower end BE'.

In Step S140, the image processing portion 11 creates image data (second image data) that causes the printing portion 20 to execute the normal printing process in a case in which the execution of the normal printing process is determined in Step S130 (FIG. 2). More specifically, when the second image data is created to correspond to a pass that is not the last pass which prints the lower end portion of a target image, the allocation destination of each pixel that configures a raster line that is positioned furthest on the downstream side DS within a divided region is determined as the nozzle Nz (nozzle number #N) furthest on the downstream side DS of a nozzle row NL. In addition, the relationship of the allocation of other pixels of the second image data and other nozzles Nz is also determined using such an allocation destination relationship as a basis. In addition, when the second image data is created to correspond to the last pass, which prints the lower end portion of a target image, the allocation destination of each pixel that configures a raster line that corresponds to the position of the fixed lower end BE' is determined as the nozzle Nz (nozzle number #1) furthest on the upstream side US of a nozzle row NL. In addition, the relationship of the allocation of other pixels of the second image data and other nozzles Nz is also determined using such an allocation destination relationship as a basis.

Figure 10:
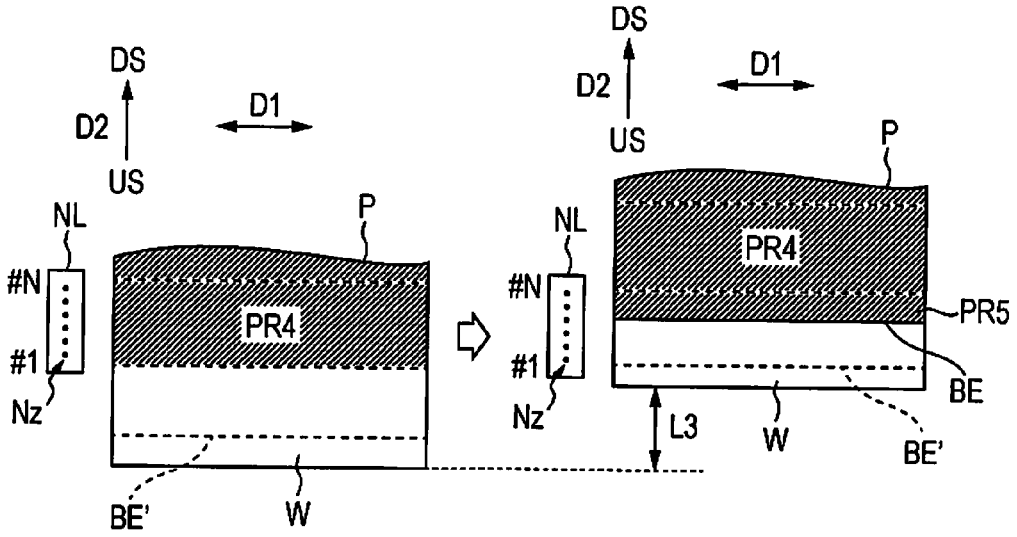
FIG. 10 is a view that shows an aspect in which a normal lower end process according to a modification example is executed.

FIG. 10 illustrates an aspect in which the printing portion 20 executes a normal printing process (the normal lower end process) according to the modification example in the last pass for printing a single page by way of example. The point of view of FIG. 10 is similar to those of FIGS. 7A and 7B. According to FIG. 10, the last pass, which prints the image PR5, is executed in a state in which the fixed lower end BE' on the sheet of paper P is matched with the position of the nozzles Nz furthest of the upstream side US (nozzle number #1). In such a normal lower end process, the printing mechanism control portion 21 causes the transport portion 26 to transport (perform paper feeding) the sheet of paper P to the downstream side DS in the transport direction D2 up to a position at which the fixed lower end BE' is printed on by the nozzle Nz (nozzle number #1) furthest on the upstream side US after the finish of the fourth pass and before initiation of the last pass. In FIG. 10, a paper feeding amount required in the normal lower end process according to the modification example is shown using the reference symbol L3. Supposing a case in which a practical lower end of a target image, or in other words, the lower end BE, coincides with the fixed lower end BE', the paper feeding amount L3=the paper feeding amount L1. However, since there are often cases in which the lower end BE does not coincide with the fixed lower end BE' (the lower end BE is positioned further on the downstream side DS than the fixed lower end BE'), the paper feeding amount L1≤the paper feeding amount L3. Accordingly, it can also be said that the normal lower end process according to the modification example is likely to contribute to an increase in the speed of printing in comparison with the lower end process for overlapping transport.

The nozzle Nz furthest on the upstream side US (nozzle number #1) and the nozzle Nz furthest on the downstream side DS (nozzle number #N) that have been described up until this point are not limited to indicating endmost nozzles Nz in a nozzle row NL in a practical sense. For example, there are cases in which the nozzle rows NL include nozzles that are not used in printing (dummy nozzles) in the respective end portions on the upstream side US and the downstream side DS. In a case in which there are such dummy nozzles, respective nozzles Nz on the upstream side US and the downstream side DS are specified from among nozzles Nz excluding dummy nozzles among the nozzles Nz that configure the nozzle rows NL. In addition, the concept of the printing of the predetermined unit is not limited to a single pass of the printing head 22. For example, the printing apparatus 10 may be configured to print an image that corresponds to a single divided region divided into a plurality of passes using the printing head 22.

The entire disclosure of Japanese Patent Application No. 2016-056872, filed Mar. 22, 2016 is expressly incorporated by reference herein.

What is claimed is:

1. A printing apparatus comprising:

a data processing portion that creates image data including at least a first image data and a second image data each of which corresponds to printing of a predetermined unit, the data processing portion creating the first image data prior to the second image data;

a transport portion that transports a printing medium in a transport direction; and a printing portion that executes the printing of the predetermined unit on the printing medium on the basis of the image data, the printing portion including a plurality of nozzles each of which discharges ink, the data processing portion determining whether or not the second image data is created prior to or during printing of the first image data, to determine whether or not the creation of image data precedes the printing, in response to determining that the second image data is created prior to or during printing of the first image data, as a first printing process, the data processing portion causing a first part of the nozzles to print a part of the second image data, which corresponds to a lower end portion of an image of a printing target, and causing the transport portion to execute overlapping transport of the printing medium such that an upstream end portion of the printing medium overlaps a portion of a succeeding print medium, the first part of the nozzles being arranged on an upstream side in the transport direction among the nozzles, and in response to determining that the second image data is not created prior to or during printing of the first image data, as a second printing process, the data processing portion causing a second part of the nozzles to print the part of the second image data, and causing the transport portion to transport the print medium without executing the overlapping transport of the printing medium, the second part of the nozzles being arranged on a downstream side in the transport direction among the nozzles.

2. The printing apparatus according to claim 1, wherein the data processing portion causes the transport portion to execute the overlapping transport, which transports the portion of the succeeding printing medium overlapped with a blank space on the lower end portion side of the printing medium as the first printing process.

3. The printing apparatus according to claim 1, wherein as the first printing process, the data processing portion causes only the first part of the nozzles, which includes a nozzle arranged on a most upstream side in the transport direction among the nozzles.

4. The printing apparatus according to claim 1, wherein as the second printing process, the data processing portion causes the second part of the nozzles, which includes a nozzle arranged on a most downstream side in the transport direction among the nozzles.

5. The printing apparatus according to claim 1, wherein the second printing process is a process that prints the lower end portion on the printing medium in a state in which nozzles that are furthest on an upstream side, among the nozzles, are caused to correspond to a position on the printing medium at which a predetermined distance of blank space is left open toward a downstream side of the transport from an end on the upstream side of the transport direction of the printing medium.

6. The printing apparatus according to claim 1, wherein the data processing portion stores the image data created for each predetermined unit in a predetermined buffer, wherein the printing portion executes printing by reading the image data from the buffer, and wherein the data processing portion performs the determination on the basis of the amount of the image data of each predetermined unit, and a pre-printing image data amount that is stored in the buffer.

7. A printing method comprising:

creating image data including at least a first image data and a second image data each of which corresponds to printing of a predetermined unit, the creating of the image data including creating the first image data prior to the second image data;

transporting a printing medium in a transport direction;

executing printing of the predetermined unit on the printing medium on the basis of the image data by a printing portion, the printing portion including a plurality of nozzles each of which discharges ink; and determining whether or not the second image data is created prior to or during printing of the first image data, to determine whether or not the creation of image data precedes the printing, in response to determining that the second image data is created prior to or during printing of the first image data, as a first printing process, the creating of the image data including creating of the image data to cause a first part of the nozzles to print a part of the second image data, which corresponds to a lower end portion of an image of a printing target, and to cause the transport portion to execute overlapping transport of the printing medium such that an upstream end portion of the printing medium overlaps a portion of a succeeding print medium, the first part of the nozzles being arranged on an upstream side in the transport direction among the nozzles, and in response to determining that the second image data is not created prior to or during printing of the first image data, as a second printing process, the creating of the image data including creating the image data to cause a second part of the nozzles to mint the part of the second image data, and to cause the transport portion to transport the print medium without executing the overlapping transport of the printing medium, the second part of the nozzles being arranged on a downstream side in the transport direction among the nozzles.

8. The printing method according to claim 7, wherein the executing of the printing includes executing the overlapping transport, which transports the portion of the succeeding printing medium overlapped with a blank space on the lower end portion side of the printing medium as the first printing process.

9. The printing method according to claim 7, wherein as the first printing process, the creating of the image data includes creating the image data to cause only the first part of the nozzles, which includes a nozzle arranged on a most upstream side in the transport direction among the nozzles.

10. The printing method according to claim 7, wherein as the second printing process, the creating of the image data includes creating the image data to cause the second part of the nozzles, which includes a nozzle arranged on a most downstream side in the transport direction among the nozzles.

11. The printing method according to claim 7, wherein the second printing process is a process that prints the lower end portion on the printing medium in a state in which nozzles that are furthest on an upstream side, among the nozzles, are caused to correspond to a position on the printing medium at which a predetermined distance of blank space is left open toward a downstream side of the transport from an end on the upstream side of the transport direction of the printing medium.

12. The printing method according to claim 7, wherein, in the creating of the image data, the image data created for each predetermined unit are stored in a predetermined buffer, wherein, in the executing of the printing, printing is executed by reading the image data from the buffer, and wherein, in the creating of the image data, the determination is performed on the basis of the amount of the image data of each predetermined unit, and a pre-printing image data amount that is stored in the buffer.

* * * * *